US008125437B2

(12) United States Patent
Chia et al.

(10) Patent No.: US 8,125,437 B2
(45) Date of Patent: Feb. 28, 2012

(54) OVER-DRIVING DEVICE

(75) Inventors: Pang-Chiang Chia, Hsinchu (TW); Chun-Hung Huang, Hsinchu (TW); Yao-Jen Hsieh, Hsinchu (TW); Heng-Sheng Chou, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 990 days.

(21) Appl. No.: 11/836,829

(22) Filed: Aug. 10, 2007

(65) Prior Publication Data

US 2009/0009461 A1 Jan. 8, 2009

(30) Foreign Application Priority Data

Jul. 6, 2007 (TW) ..... 96124655 A

(51) Int. Cl.
*G09G 3/36* (2006.01)

(52) U.S. Cl. ..... 345/99

(58) Field of Classification Search ..... 345/98, 345/87, 89, 204, 99
See application file for complete search history.

(56) References Cited

U.S. PATENT DOCUMENTS

| | | | | |
|---|---|---|---|---|
| 7,397,457 | B2 * | 7/2008 | Sugino et al. | 345/89 |
| 2004/0155847 | A1 * | 8/2004 | Taoka et al. | 345/87 |
| 2005/0162566 | A1 * | 7/2005 | Chuang et al. | 348/714 |
| 2005/0237316 | A1 * | 10/2005 | Huang et al. | 345/204 |
| 2006/0164365 | A1 * | 7/2006 | Huang et al. | 345/98 |
| 2006/0222080 | A1 * | 10/2006 | Wang | 375/240.24 |

FOREIGN PATENT DOCUMENTS

| | | |
|---|---|---|
| TW | I235980 | 7/2005 |
| TW | 200627338 A | 8/2006 |
| TW | I269254 | 12/2006 |

OTHER PUBLICATIONS

English abstract of TW200627338A, pub. Aug. 1, 2006.
English abstract of TWI235980, pub. Jul. 11, 2005.

* cited by examiner

*Primary Examiner* — Quan-Zhen Wang
*Assistant Examiner* — Tony Davis
(74) *Attorney, Agent, or Firm* — Thomas|Kayden

(57) ABSTRACT

An over-driving device is provided. In a first frame, a compression circuit compresses a first image signal to generate a first compression image signal, and a buffer temporarily stores the first compression image signal. In a following second frame, the compression circuit compresses a second image signal to generate a second compression image signal, and the buffer outputs the first compression image signal to serve as a first buffer image signal. A comparison circuit compares the second compression image signal and the first buffer image signal and generates an enable signal according comparison result. A decompression circuit decompresses the first buffer image signal to generate a previous image signal. An over-driving unit receives the second image signal to serve to a current image signal and receives the previous image signal and the enable signal. The over-driving unit over drives the display device or not according to the enable signal.

16 Claims, 8 Drawing Sheets

OVER-DRIVING DEVICE

BACKGROUND OF THE INVENTION

1. Field of the Invention

The invention relates to an over-driving device, and more particularly to an over-driving device applied in a display panel.

2. Description of the Related Art

FIGS. 1A and 1B respectively show the variations of gray values and brightness of a pixel when a response time of a liquid crystal display panel is excessively long. Referring FIGS. 1A and 1B, in an ideal situation, when the desired gray value of a pixel is changed from G0 to G1 at time point T0, the brightness thereof is changed from L0 to L1. However, since the rotational speed of liquid crystal molecules of a pixel is slow, the response time during which the brightness is changed from L0 to L1 is excessively long, and the brightness reaches L1 at time point T2. Thus, the brightness of the pixel can not reach the desired degree L1 in a frame.

Since large-sized liquid crystal display panels are continuously being developed, it is important to shorten response time of a liquid crystal display panel. In order to solve the problem of a long response time, an over-driving method is used. FIGS. 2A and 2B respectively show the variations of gray values and brightness of a pixel utilizing an over-driving method. Referring to FIG. 2A, to shorten response time, the desired gray value of a pixel is changed from G0 to G1' (G1'>G1) at time point T0 and then changed from G1' to G1 at time point T1. As shown in FIG. 2B, brightness of the pixel reaches L1 at time point T1, wherein the duration between time points T0 and T1 is shorter than the duration between time points T0 and T2. Thus, by using an over-driving method, response time required for brightness change of a liquid crystal display panel from one frame to the next frame is shortened.

Taiwan Patent No. I269254 discloses an over-driving device and a method thereof. Referring to FIG. 3, an over-driving device 300 comprises a compression circuit 310, a buffer 312, two decompression circuits 314-1 and 314-2, a comparison circuit 316, a multiplexer 318, and an over-driving module 320. The compression circuit 310 receives and compresses a source signal to generate a compression data signal 311. The buffer 312 receives the compression data signal 311 to temporarily store compression data of gray values in a frame and generate a buffering data signal which is output in a next frame. The decompression circuits 314-1 and 314-2 decompress the buffing data signal 313 and the compression data signal 311 to generate decompression data signals 315-1 and 315-2, respectively. The comparison circuit 316 compares the decompression data signals 315-1 and 315-2. In other words, the comparison circuit 316 compares gray values of the pixel (not shown) in the current and previous frames and then drives the over-driving module 320 to perform following operations according to the comparison result.

BRIEF SUMMARY OF THE INVENTION

An exemplary embodiment of an over-driving device is applied in a display device which comprises a plurality of pixels and displays images in successive frames. The over-driving device comprises a compression circuit, a buffer, a comparison circuit, a decompression circuit, and an over-driving unit. The compression circuit receives and compresses a first image signal to generate a first compression image signal in a first frame, and receives and compresses a second image signal to generate a second compression image signal in a second frame following the first frame. The buffer is coupled to the compression circuit. The buffer receives and temporarily stores the first compression image signal in the first frame and outputs the stored first compression image signal to serve as a first buffering image signal in the second frame. The comparison circuit is coupled to the compression circuit and the buffer. The comparison circuit receives and compares the second compression image signal and the first buffering image signal and generates an enable signal according to the comparison result in the second frame. The decompression circuit is coupled to the buffer. The decompression circuit receives and decompresses the first buffering image signal to generate a previous image signal in the second frame. The over-driving unit receives the second image signal to serve as a current image signal, receives the previous image signal and the enable signal, and determines to over drive the display device or not according to the enable signal in the second frame.

In some embodiments, the over-driving device further comprises a delay circuit coupled to the compression circuit and the comparison circuit. The delay circuit delays the second compression image signal for a predetermined period.

In some embodiments, the over-driving device further comprises a delay circuit coupled to the buffer circuit and the comparison circuit. The delay unit delays the first buffering image signal for a predetermined period.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
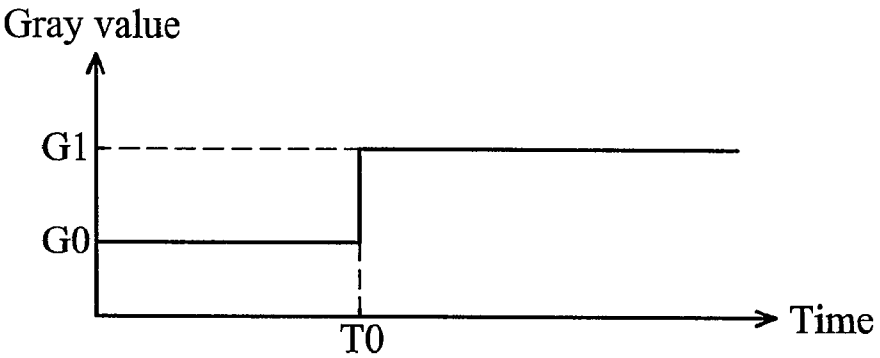
FIG. 1A (RELATED ART)
FIGS. 1A and 1B respectively show the variations of gray values and brightness of a pixel when a response time of a liquid crystal display panel is excessively long.
Figure 1B:
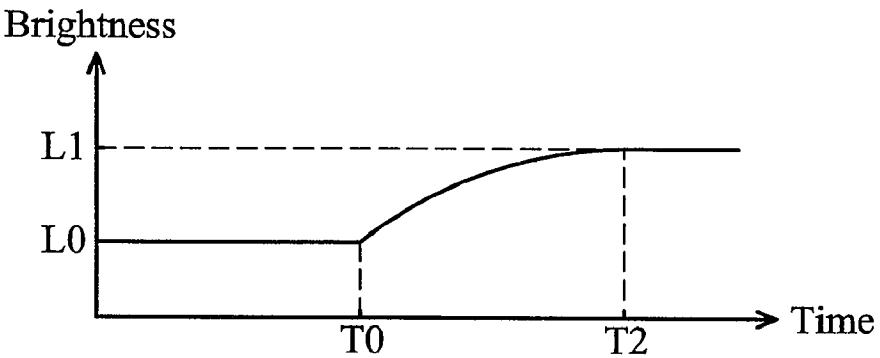
FIG. 1B (RELATED ART)
Figure 2A:
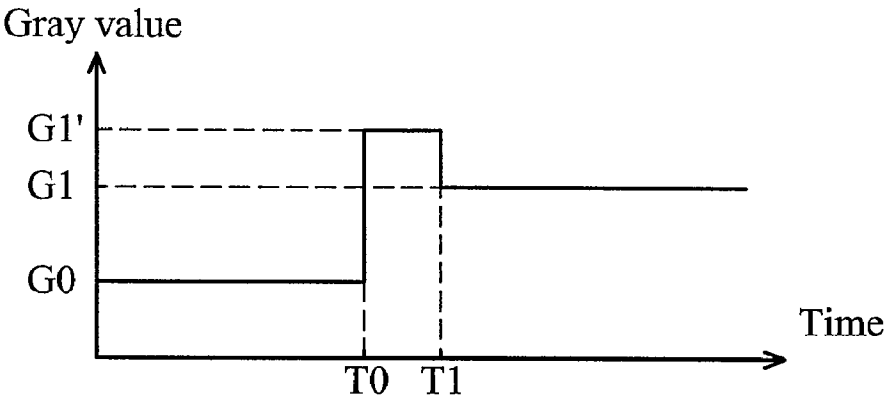
FIG. 2A (RELATED ART)
FIGS. 2A and 2B respectively show the variations of gray values and brightness of a pixel in an over-driving method.
Figure 2B:
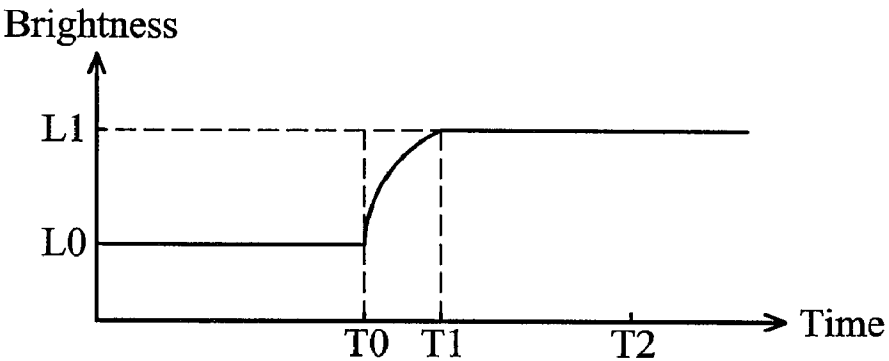
FIG. 2B (RELATED ART)
Figure 3:
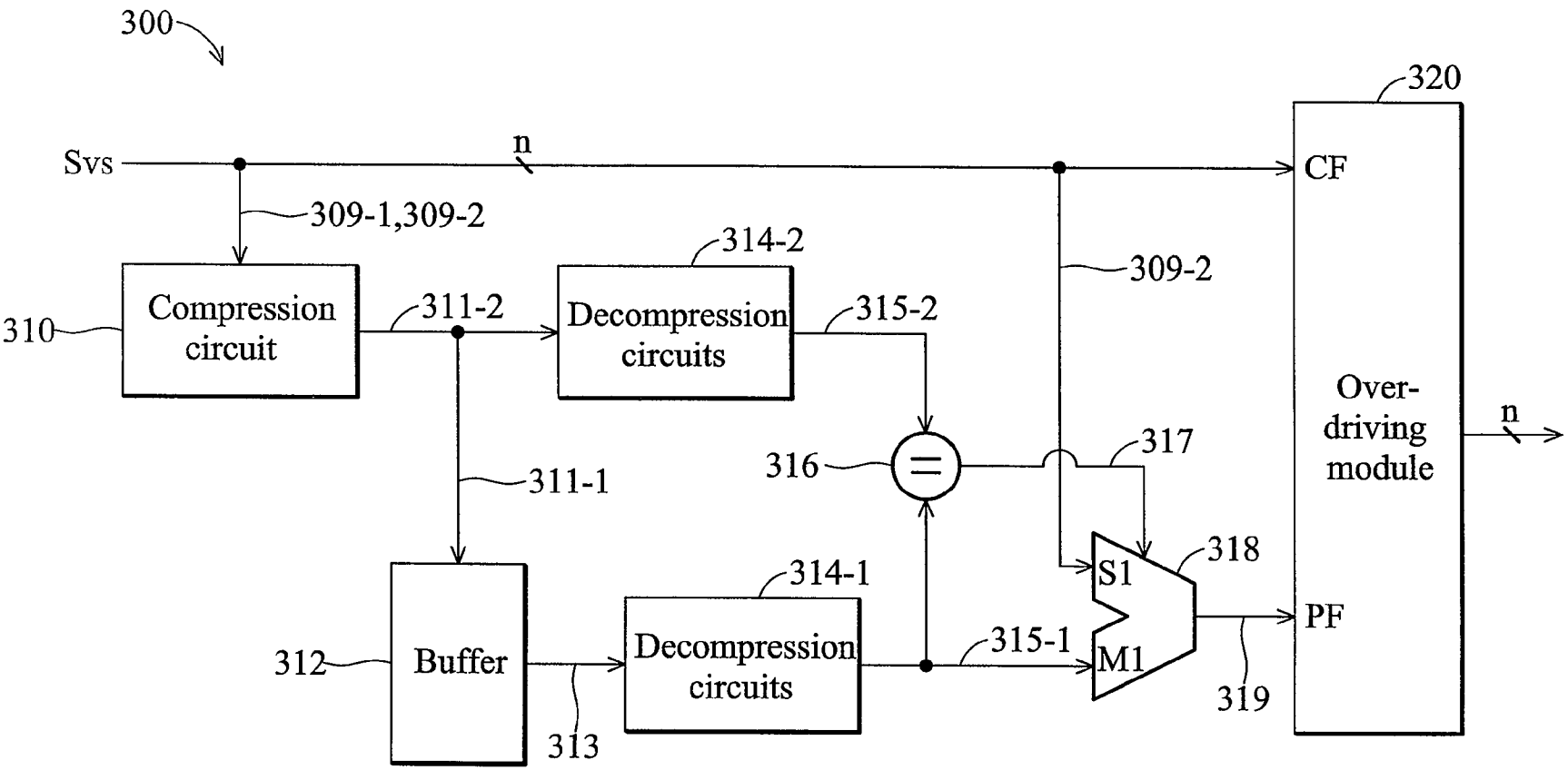
FIG. 3 (RELATED ART)
FIG. 3 shows an over-driving device disclosed by Taiwan Patent No. I269254.
Figure 4:
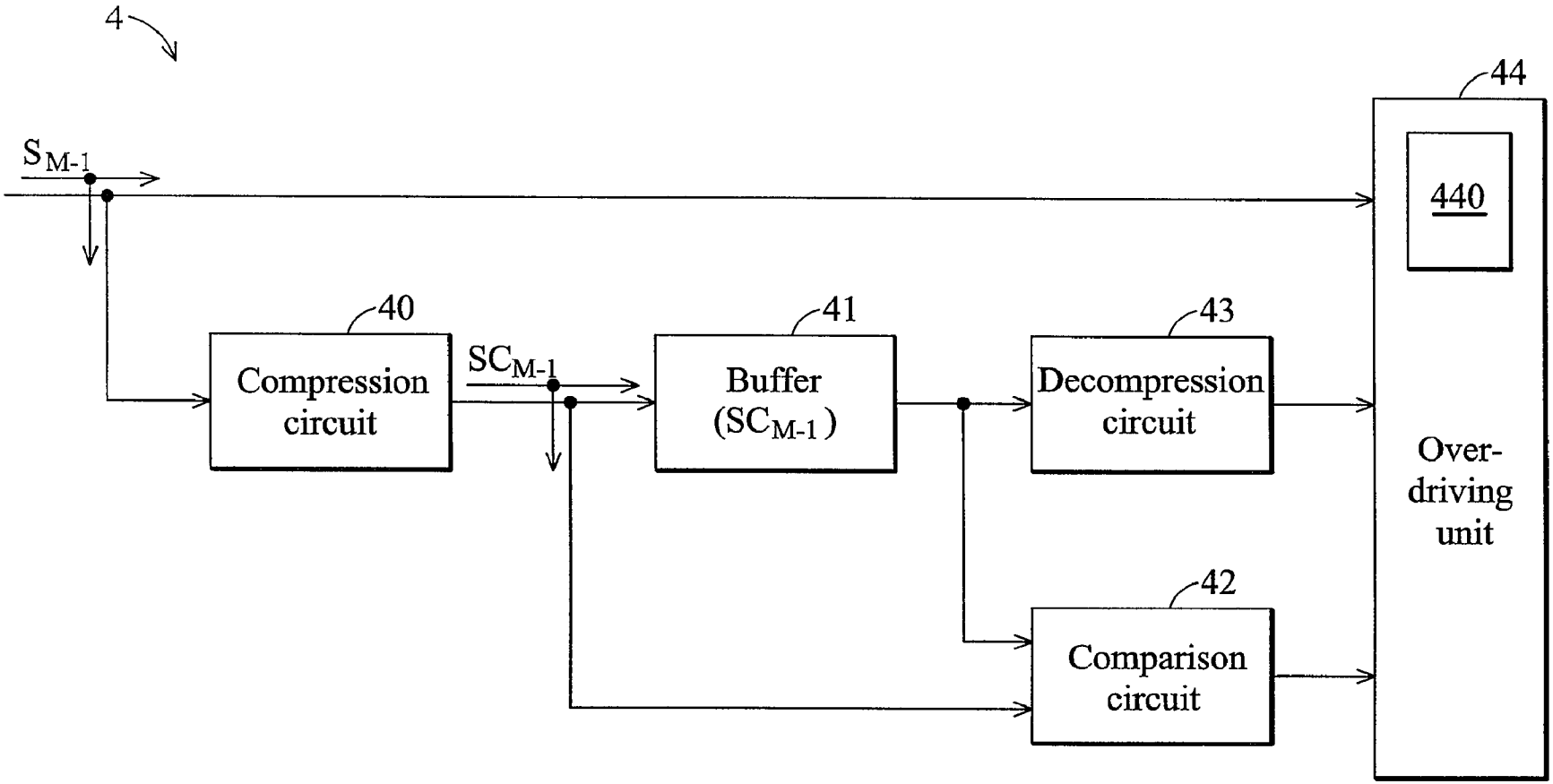
FIG. 4 shows an exemplary embodiment of an over-driving device and the transmission of signals in a frame $F_{M-1}$.

Over-driving devices are provided. In an exemplary embodiment of an over-driving device in FIG. 4, an over-driving device 4 is applied in a display device, such as a liquid crystal display device. The display device comprises a plurality of pixels and displays images in successive frames. As shown in FIG. 4, the over-driving device 4 comprises compression circuit 40, a buffer 41, a comparison circuit 42, a decompression circuit 43, and an over-driving unit 44. In following description, three successive frames $F_{M-1}$, $F_M$, and $F_{M+1}$ in which the over-driving device 4 operates are given as an example.

Referring to FIG. 4, in the frame $F_{M-1}$, the compression circuit 40 receives an image signal $S_{M-1}$. The compression circuit 40 compresses the image signal $S_{M-1}$ to generate a compression signal $SC_{M-1}$. The buffer 41 is coupled to the compression circuit 40. The buffer 41 receives the compression signal $SC_{M-1}$ and stores it temporarily for outputting in the next frame $F_M$.

Figure 5:
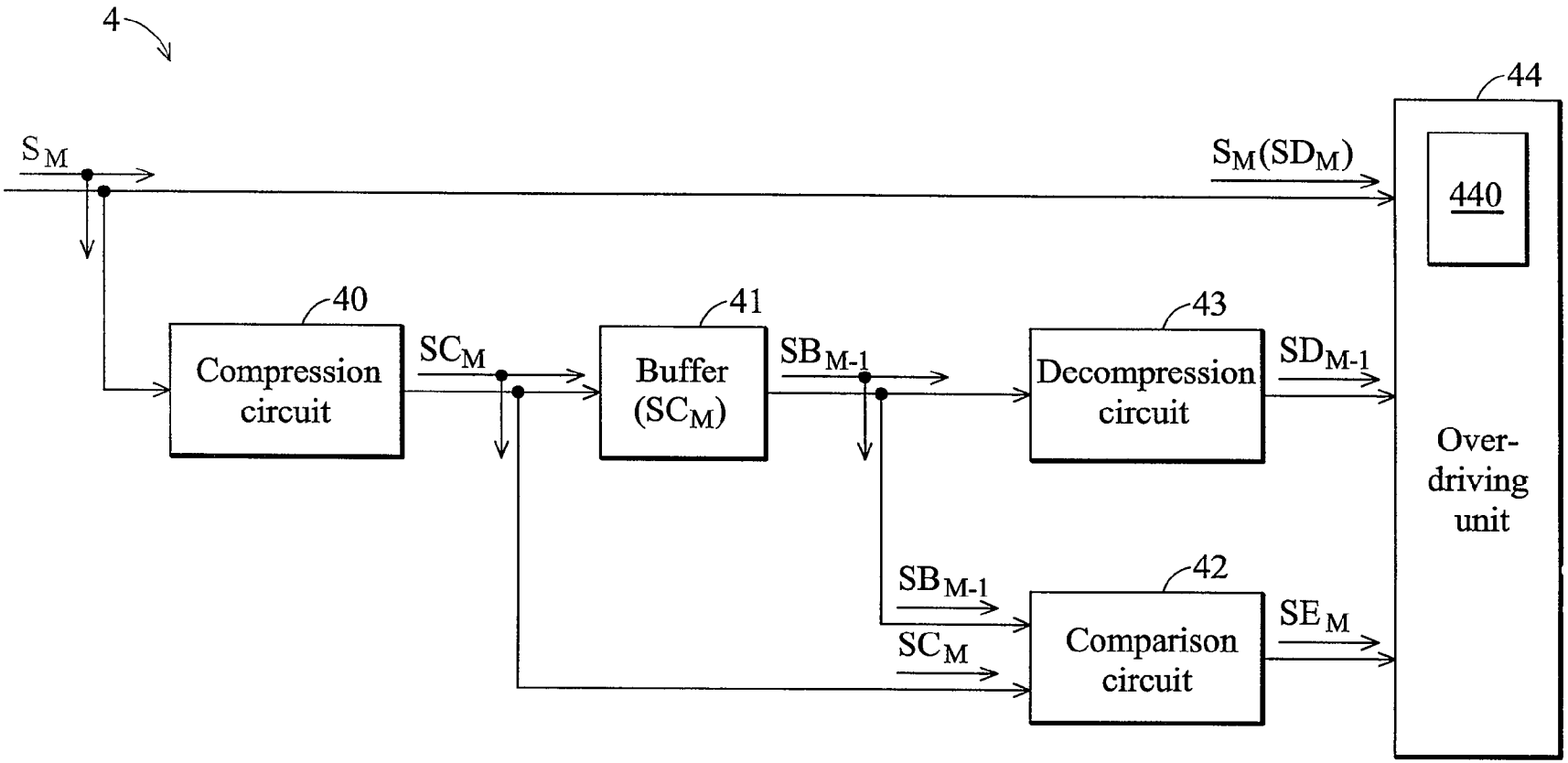
FIG. 5 shows the transmission of signals in the over-driving device in a frame $F_M$.

Referring to FIG. 5, in the frame $F_M$, the compression circuit 40 receives an image signal $S_M$. The compression circuit 40 compresses the image signal $S_M$ to generate a compression signal $SC_M$. After the compression circuit 40 generates the compression signal $SC_M$, the buffer 41 receives and temporarily stores the compression signal $SC_M$ for outputting in the next frame $F_{M+1}$ to serve as a buffering image signal $SB_M$, and, at the same time, the buffer 41 outputs the compression signal $SC_{M-1}$ to serve as a buffering image signal $SB_{M-1}$. The decompression circuit 43 is coupled to the buffer 41. In the frame $F_M$, the decompression circuit 43 receives and decompresses the buffering image signal $SB_{M-1}$ from the buffer 41 to generate a previous image signal $SD_{M-1}$ for the frame $F_M$.

The comparison circuit 42 is coupled to the compression circuit 40 and the buffer 41. In the frame $F_M$, the comparison circuit 42 receives and compares the compression image signal $SC_M$ and the buffering image signal $SB_{M-1}$. The comparison circuit 42 generates an enable signal $SE_M$ according to the comparison result. The over-driving unit 44 receives the image signal $S_M$ to serve as a current image signal $SD_M$ for the frame $F_M$. The over-driving unit 44 also receives the previous image signal $SD_{M-1}$ and the enable signal $SE_M$. The over-driving unit 44 determines to over drive the display device or not in the frame $F_M$ according to the enable signal $SE_M$.

In some embodiments, in the frame $F_M$, when the current image signal $SD_M$ and the buffering image signal $SB_{M-1}$ are the same, the comparison circuit 42 outputs a de-asserted enable signal $SE_M$ for driving the over-driving unit 44 to stop over driving the display device. When the current image signal $SD_M$ and the buffering image signal $SB_{M-1}$ are different, the comparison circuit 42 outputs an asserted enable signal $SE_M$ for driving the over-driving to over drive the display device.

In some other embodiments, the comparison circuit 42 has a reference value. When the difference between the compression image signal $SC_M$ and the buffering image signal $SB_{M-1}$ is less than or equal to the reference value, the comparison circuit 42 outputs a de-asserted enable signal $SE_M$ for driving the over-driving unit 44 to stop over driving the display device. When the difference between the compression image signal $SC_M$ and the buffering image signal $SB_{M-1}$ is greater than the reference value, the comparison circuit 42 outputs an asserted enable signal $SE_M$ for driving the over-driving unit 44 to over drive the display device.

The over-driving unit 44 comprises a table 440. The table 440 comprises a plurality of over-driving parameters. When the over-driving unit 44 determines to over drive the display device according to the enable signal $SE_M$, the over-driving unit 44 checks the table 440 to select one over-driving parameter corresponding to the combination of the current image signal $SD_M$ and the previous image signal $SD_{M-1}$. The over-driving unit 44 over drives the display device according to the selected over-driving parameter. When the over-driving unit 44 determines to stop driving the display device according to the enable signal $SE_M$, the over-driving unit 44 stops checking the table 440.

In the embodiments in FIGS. 4 and 5, the image signal $S_{M-1}$ comprises a gray value of a target pixel in the frame $F_{M-1}$, and the image signal $S_M$ comprises a gray value of the target pixel in the frame $F_M$. However, the invention is not limited to the disclosed embodiments.

In some embodiments, the image signal $S_{M-1}$ can comprise gray values of a predetermined number of pixels in the frame $F_{M-1}$, and the image signal $S_M$ can comprise gray values of the predetermined number of pixels in the frame $F_M$. In these examples, the comparison circuit 42 compares gray values corresponding to the predetermined number of pixels in the compression image signal $SC_M$ and gray values corresponding to the predetermined number of pixels in the buffering image signal $SB_{M-1}$ in a predetermined order. When determining to over drive the display device according to the enable signal $SE_M$, the over-driving unit 44 over drives the predetermined number of pixels in the predetermined order.

Figure 6:
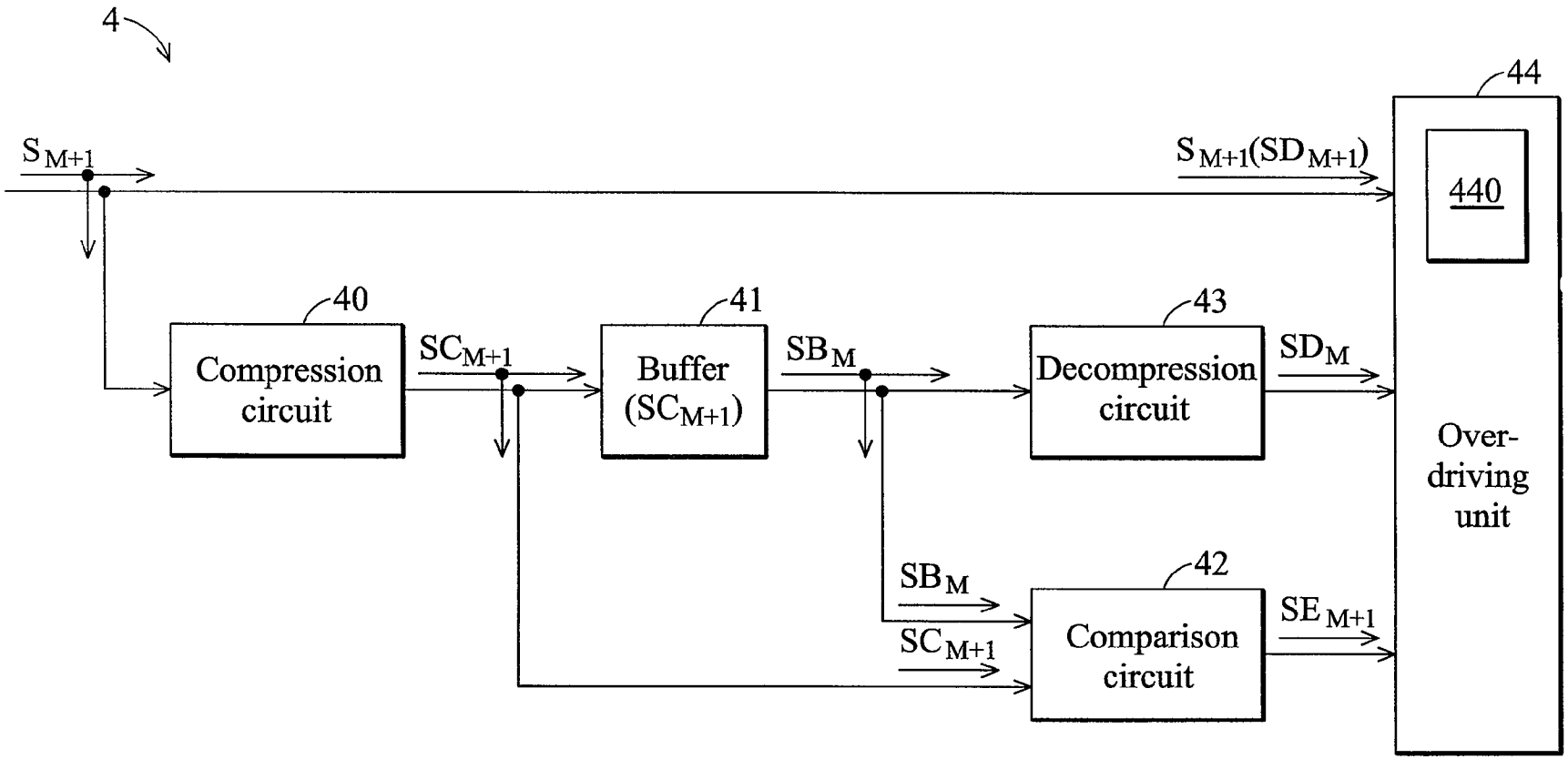
FIG. 6 shows the transmission of signals in the over-driving device in a frame $F_{M+1}$.

Referring to FIG. 6, in the frame $F_{M+1}$, the compression circuit 40 receives an image signal $S_{M+1}$. The compression circuit 40 compresses the image signal $S_{M+1}$ to generate a compression signal $SC_{M+1}$. After the compression circuit 40 generates the compression signal $SC_{M+1}$, the buffer 41 receives and temporarily stores the compression signal $SC_{M+1}$ for outputting in a next frame, and, at the same time, the buffer 41 outputs the compression signal $SC_M$ to serve as a buffering image signal $SB_M$. In the frame $F_{M+1}$, the decompression circuit 43 receives and decompresses the buffering image signal $SB_M$ from the buffer 41 to generate a previous image signal $SD_M$ for the frame $F_{M+1}$.

In the frame $F_{M+1}$, the comparison circuit 42 receives and compares the compression image signal $SC_{M+1}$ and the buffering image signal $SB_M$. The comparison circuit 42 generates an enable signal $SE_{M+1}$ according to the comparison result. The over-driving unit 44 receives the image signal $S_{M+1}$ to serve as a current image signal $SD_{M+1}$ for the frame $F_{M+1}$. The over-driving unit 44 also receives the previous image signal $SD_M$ and the enable signal $SE_{M+1}$. The over-driving unit 44 determines to over drive the display device or not in the frame $F_{M+1}$ according to the enable signal $SE_{M+1}$.

In the embodiments of FIGS. 4-6, the buffer 41 with a reading-writing synchronization mode is given as an example. In some embodiments, the buffer 41 can be in a writing prior to reading mode or a reading prior to writing mode.

Figure 7:
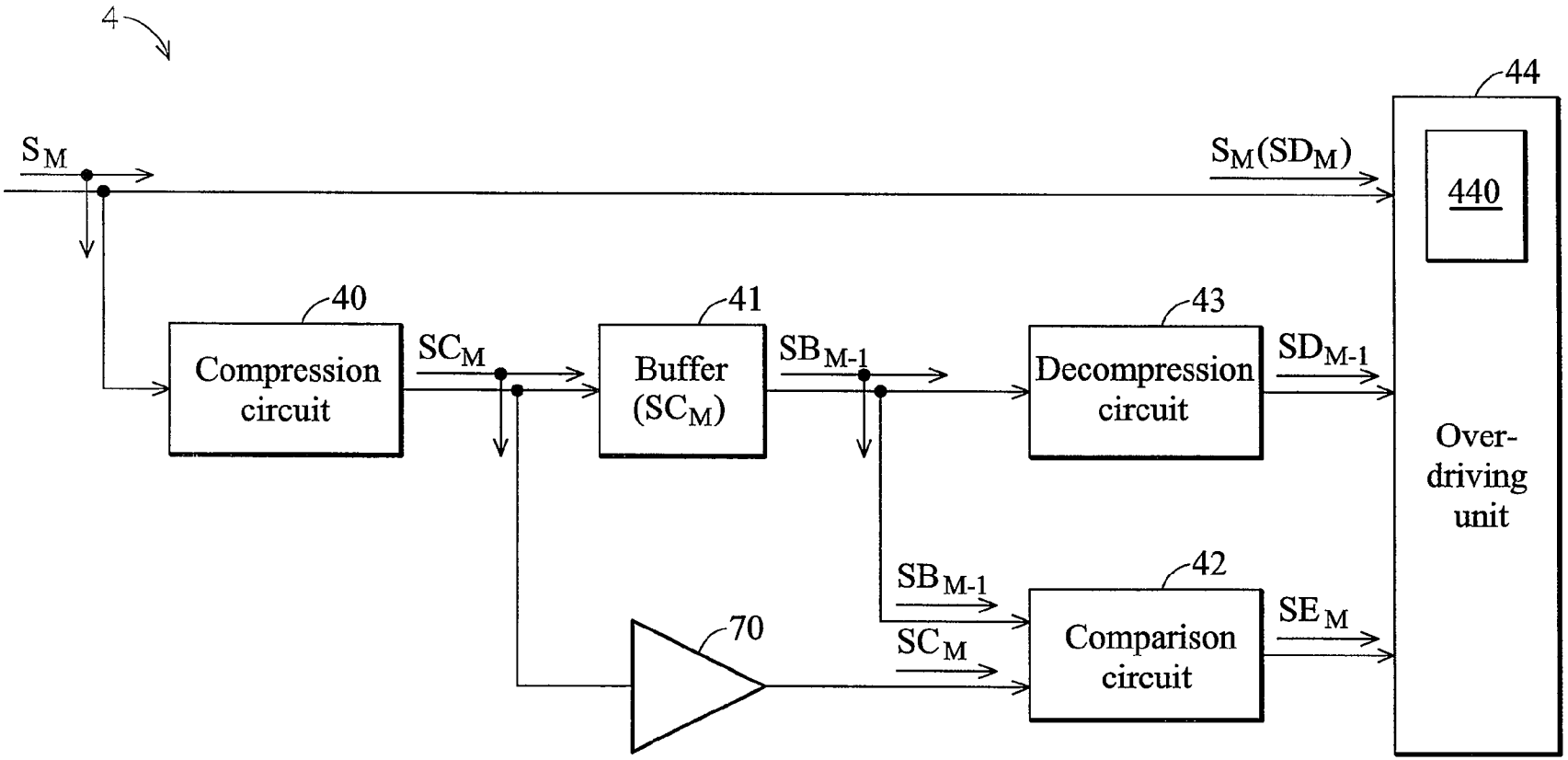
FIG. 7 shows an exemplary embodiment of an over-driving device with a delay circuit coupled between a compression circuit and a comparison circuit.

Referring to FIG. 7, when the buffer 41 is in a writing prior to reading mode, the over-driving device 4 further comprises a delay circuit 70 coupled between the compression circuit 40 and the comparison circuit 42. In the frame $F_M$, since the compression image signal $SC_M$ is written into the buffer 41 first and then the buffering image signal $SB_{M-1}$ is read from the buffer 41, there is a predetermined period between the time point the compression circuit 40 generates the compression image signal $SC_M$ and the time point the buffer 41 outputs the buffering image signal $SB_{M-1}$. In other words, the time point the compression circuit 40 generates the compression image signal $SC_M$ is earlier than the time point the buffer 41 outputs the buffering image signal $SB_{M-1}$. The delay circuit 70 receives the compression image signal $SC_M$ and delays the compression image signal $SC_M$ for the predetermined period, so that the compression image signal $SC_M$ and the buffering image signal $SB_{M-1}$ can reach the comparison circuit 42 at the same time.

Figure 8:
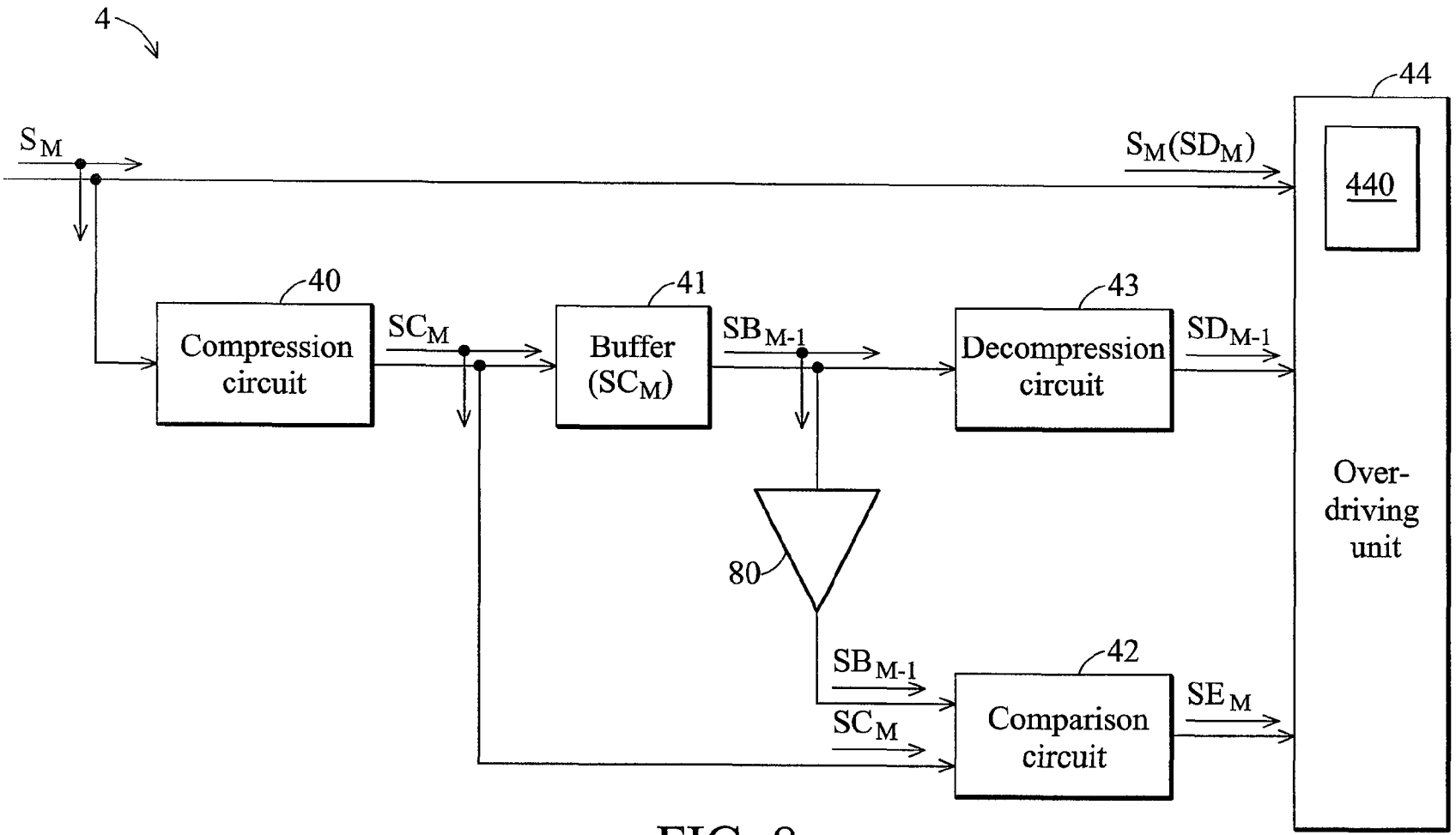
FIG. 8 shows an exemplary embodiment of an over-driving device with a delay circuit coupled between the buffer and the comparison circuit.

Referring to FIG. 8, when the buffer 41 is in a reading prior to writing mode, the over-driving device 4 further comprises a delay circuit 80 coupled between the buffer 41 and the comparison circuit 42. In the frame $F_M$, since the buffering image signal $SB_{M-1}$ is read from the buffer 41 first and then the compression image signal $SC_M$ is written into the buffer 41, there is a predetermined period between the time point the compression circuit 40 generates the compression image signal $SC_M$ and the time point the buffer 41 outputs the buffering image signal $SB_{M-1}$. In other words, the time point the buffer 41 outputs the buffering image signal $SB_{M-1}$ is earlier than the time point the compression circuit 40 generates the compression image signal $SC_M$. The delay circuit 80 receives the buffering image signal $SB_{M-1}$ and delays the buffering image signal $SB_{M-1}$ for the predetermined period, so that the compression image signal $SC_M$ and the buffering image signal $SB_{M-1}$ can reach the comparison circuit 42 at the same time.

According above embodiments, by comparing the compression image signal $SC_{M-1}$ corresponding to the current frame and the buffering image signal $SB_M$ corresponding to the previous frame, the over-driving unit 44 determines to over drive the display device in the current frame.

Moreover, the over-driving device 4 comprises only one decompression circuit, saving circuit space. Since the comparison circuit 42 compares decompressed signals, the band width of data buses for the comparison circuit 42 is decreased.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An over-driving device for a display device comprising a plurality of pixels and displaying images in successive frames, with the over-driving device comprising:

a compression circuit for receiving and compressing a first image signal to generate a first compression image signal in a first frame, and receiving and compressing a second image signal to generate a second compression image signal in a second frame following the first frame;

a buffer, coupled to the compression circuit, for receiving and temporarily storing the first compression image signal in the first frame and outputting the stored first compression image signal to serve as a first buffering image signal in the second frame;

a comparison circuit, coupled to the compression circuit and the buffer, for receiving and comparing the second compression image signal and the first buffering image signal and generating an enable signal according to a comparison result in the second frame;

a decompression circuit, coupled to the buffer, for receiving and decompressing the first buffering image signal to generate a previous image signal in the second frame; and an over-driving unit for receiving the second image signal to serve as a current image signal, receiving the previous image signal and the enable signal, and determining to over drive the display device or not according to the enable signal in the second frame.

2. The over-driving device as claimed in claim 1, wherein when the second compression image signal and the first buffering image signal are the same, the comparison circuit outputs the de-asserted enable signal for driving the over-driving unit to stop over driving the display device.

3. The over-driving device as claimed in claim 2, wherein when the second compression image signal and the first buffering image signal are different, the comparison circuit outputs the asserted enable signal and drives the over-driving unit for over driving the display device.

4. The over-driving device as claimed in claim 1, wherein the comparison circuit has a reference value, and the comparison circuit outputs the de-asserted enable signal for driving the over-driving unit to stop over driving the display device when the difference between the second compression image signal and the first buffering image signal is less than or equal to the reference value.

5. The over-driving device as claimed in claim 4, wherein when the difference between the second compression image signal and the first buffering image signal is greater than the reference value, the comparison circuit outputs the asserted enable signal for driving the over-driving device to over drive the display device.

6. The over-driving device as claimed in claim 1, wherein the over-driving unit comprises a table comprising a plurality of over-driving parameters.

7. The over-driving device as claimed in claim 6, wherein when the over-driving unit determines to over drive the display device according to the enable signal, the over-driving unit checks the table to select one over-driving parameter corresponding to the combination of the current image signal and the previous image signal for over driving the display device.

8. The over-driving device as claimed in claim 7, wherein when the over-driving unit determines to stop driving the display device according to the enable signal, the over-driving unit stops checking the table.

9. The over-driving device as claimed in claim 1, wherein the first image signal comprises a gray value of a target pixel among the plurality of pixels in the first frame, and the second image signal comprises a gray value of the target pixel in the second.

10. The over-driving device as claimed in claim 1, wherein the first image signal comprises gray values of a predetermined number of pixels among the plurality of pixels in the first frame, and the second image signal comprises gray values of the predetermined number of pixels in the second frame.

11. The over-driving device as claimed in claim 10, wherein the comparison circuit compares gray values corresponding to the predetermined number of pixels in the second compression image signal and gray values corresponding to the predetermined number of pixels in the first buffering image signal in a predetermined order.

12. The over-driving device as claimed in claim 11, wherein when the over-driving unit determines to drive the display device according to the enable signal, the over-driving unit over drives the predetermined number of pixels in the predetermined order.

13. The over-driving device as claimed in claim 1 further comprising a delay circuit, coupled to the compression circuit and the comparison circuit, for delaying the second compression image signal for a predetermined period.

14. The over-driving device as claimed in claim 13, wherein in the second frame, the difference between a time point that the compression circuit generates the second compression image signal and a time point that the buffer outputs the first buffering image signal is the predetermined period.

15. The over-driving device as claimed in claim 1 further comprising a delay circuit, coupled to the buffer and the comparison circuit, for delaying the first buffering image signal for a predetermined period.

16. The over-driving device as claimed in claim 1, wherein in the second frame, the difference between a time point that the compression circuit generates the second compression image signal and a time that point the buffer outputs the first buffering image signal is a predetermined period.

* * * * *